US005583532A

United States Patent [19]

Watanabe

[11] Patent Number: 5,583,532

[45] Date of Patent: Dec. 10, 1996

[54] ACTIVE MATRIX LIQUID CRYSTAL DISPLAY FOR REPRODUCING IMAGES ON SCREEN WITH FLOATING IMAGE SIGNAL

[75] Inventor: Takahiko Watanabe, Tokyo, Japan

[73] Assignee: NEC Corporation, Tokyo, Japan

[21] Appl. No.: 357,986

[22] Filed: Dec. 16, 1994

Related U.S. Application Data

[63] Continuation of Ser. No. 288,208, Aug. 9, 1994, abandoned, which is a continuation of Ser. No. 2,754, Jan. 13, 1993, abandoned.

[30] Foreign Application Priority Data

Jan. 13, 1992 [JP] Japan ..... 4-003507

[51] Int. Cl.[6] ..... G09G 3/36

[52] U.S. Cl. ..... 345/89; 345/94

[58] Field of Search ..... 345/87, 89, 90, 345/93, 94, 95, 96, 63, 208, 209, 210

[56] References Cited

U.S. PATENT DOCUMENTS

| | | | |
|---|---|---|---|
| 4,734,692 | 3/1988 | Hosono et al. | 340/805 |
| 4,761,058 | 8/1988 | Okubo et al. | 340/793 |
| 4,909,602 | 3/1990 | Kaneko et al. | 309/57 |
| 5,117,298 | 5/1992 | Hirai | 345/96 |
| 5,151,805 | 9/1992 | Takeda et al. | 345/94 |
| 5,196,738 | 3/1993 | Takahara et al. | 345/89 |

OTHER PUBLICATIONS

T. Yamagisawa et al, "Compensation of the Display Electrode Voltage Distortion", Japan Display '86, pp. 192–195.

*Primary Examiner*—Richard Hjerpe
*Assistant Examiner*—Regina Liang
*Attorney, Agent, or Firm*—Sughrue, Mion, Zinn, Macpeak & Seas

[57] ABSTRACT

An active matrix liquid crystal display allows thin film switching transistors to selectively turn on for supplying an image signal from a liquid crystal driving circuit to pixel electrodes opposed through liquid crystal to a counter electrode. The image signal has a voltage range variable with gradation to be indicated for reproducing an image. The liquid crystal driving circuit controls the image signal in such a manner as to be change a central value of the voltage range with the gradation to be reproduced at each pixel so that variation of a feed-through voltage is canceled.

13 Claims, 8 Drawing Sheets

ACTIVE MATRIX LIQUID CRYSTAL DISPLAY FOR REPRODUCING IMAGES ON SCREEN WITH FLOATING IMAGE SIGNAL

This is a Continuation of application Ser. No. 08/288,208 now abandoned, filed Aug. 9, 1994, which in turn is a continuation of Ser. No. 08/002,754, filed Jan. 13, 1993 (now abandoned).

FIELD OF THE INVENTION

This invention relates to an active matrix liquid crystal display and, more particularly, to an active matrix liquid crystal display controlled with a floating image signal indicative of the gradation of pixels.

DESCRIPTION OF THE RELATED ART

A typical example of a pixel element of the active matrix liquid crystal display is illustrated in FIG. 1 of the drawings, and the pixel element is designated by reference numeral 1. The pixel element 1 is assigned a pixel on a screen incorporated in the active matrix liquid crystal display, and comprises a thin film switching transistor 1*a* and an associated pixel electrode 1*b* coupled with the source node of the thin film switching transistor 1*a*. The associated pixel electrode 1*b* is opposed through liquid crystal to a counter electrode 1*c*, and the counter electrode 1*c* is shared with other pixel elements (not shown). The drain electrode of the thin film switching transistor 1*a* is coupled with an image signal line 2, and an image signal indicative of the gradation of the pixel is applied to the image signal line 2. The gate electrode of the thin film switching transistor 1*a* is coupled with a decoded signal line 3, and a predetermined address is assigned to the pixel element 1 and, accordingly, the associated pixel on the screen. If an address decoded signal is indicative of the address assigned to the pixel element 1, the address decoded signal line 3 goes up to high voltage level, and the thin film switching transistor 1*a* turns on. The image signal indicative of the gradation of the associated pixel is concurrently applied to the image signal line 2, and the thin film switching transistor 1*a* transfers the image signal from the image signal line 2 to the associated pixel electrode 1*b*.

The image signal is variable in voltage level together with the gradation of the associated pixel as shown in FIG. 2, and the central value of the image signal is plotted on line CTR at 8.0 volts regardless of the gradations. Thus, the image signal applied to the pixel electrode 1*b* is varied together with the gradation of the pixel, and the differential voltage between the pixel electrode 1*b* and the counter electrode 1*c* changes the transmissivity of the liquid crystal so as to adjust the luminosity of the associated pixel to the gradation indicated by the image signal. The address decoded signal sequentially designates all of the pixels on the screen, and the image signal causes the pixels to reproduce images on the screen.

However, a problem is encountered in the prior art active matrix liquid crystal display in that flicker takes place on the screen, and viewing the images on the screen is less comfortable. Moreover, images are left on the screen after removal of the image signal, and the liquid crystal is sometimes destroyed.

In detail, assuming now that the address decoded signal rises at time t1 as shown in FIG. 3, the image signal charges the pixel electrode 1*b*, and the pixel electrode 1*b* goes up to the maximum voltage level Hmax. However, the address decoded signal is recovered to the low voltage level at time t2, and the pixel electrode 1*b* is pulled down to a certain voltage level H1 due to the address decoded signal and the parasitic capacitance Cgs between the gate electrode and the source electrode of the thin film switching transistor 1*a*. The difference between the maximum voltage level Hmax and voltage level H1 is termed "feed-through voltage" dV. The pixel electrode 1*b* keeps the voltage level H1 from time t2 to time t3, and is recovered to the low voltage level together with the address decoded signal at time t4.

The feed-through voltage dV is calculated by Equation 1.

$$dV=\{Cgs/(Cgs+Ccr)\}\times Vg \qquad \text{Equation 1}$$

where Ccr is the capacitance between the pixel electrode 1*b* and the counter electrode 1*c* and Vg is the amplitude of the address decoded signal.

If any feed-through voltage dV does not take place, the counter electrode 1*c* should be adjusted to the central value of the image signal plotted on broken line CTR1. However, the feed-through voltage dV lifts the image signal throughout the accumulating time period from time t1 to time t4, and, for this reason, the counter electrode 1*c* is regulated to the optimum constant level plotted on the real line RL1 lower than the broken line CTR1 by the feed-through voltage dV for preventing the liquid crystal from direct bias voltage.

However, liquid crystal is not constant in permittivity, and is varied together with differential voltage applied across the liquid crystal film as shown in FIG. 4. As described hereinbefore, the image signal is variable in voltage level depending upon the gradation of the pixel, and the capacitance Ccr between the electrodes 1*b* and l*c* also varies together with the permittivity of the liquid crystal. This means that the feed-through voltage dV is never constant. The feed-through voltage dV4.5 at 4.5 volts is roughly given by Equation 2 on the assumption that the parasitic capacitance Cgs, the capacitance Ccr at 4.5 volts and the address decoded signal are 0.018 pF, 0.1 pF and 20 volts, respectively.

$$dV4.5=\{0.018/(0.1+0.018)\}\times 20=3.0 \text{ volts} \qquad \text{Equation 2}$$

On the other hand, the feed-through voltage dV0 at zero voltage is roughly given by Equation 3 on the assumption that the capacitance Ccr at zero voltage is 0.05 pF.

$$dV0=\{0.018/(0.05+0.018\}\times 20=5.3 \text{ volts} \qquad \text{Equation 3}$$

Thus, the feed-through voltage dV is variable with the gradation of the pixel, and causes the optimum voltage level at the counter electrode 1*c* to vary as indicated by Plots CNT in FIG. 2. If the designer takes the feed-through voltage dV at a particular point on Plots CNT so as to adjust the counter electrode 1*c* to the certain level RL1, the counter electrode 1*c* is improperly biased from the central value at the other points. This improper bias condition results in the above mentioned problems.

SUMMARY OF THE INVENTION

It is therefore an important object of the present invention to provide an active matrix liquid crystal display which is free from the problems inherent in the prior art active matrix liquid crystal display.

To accomplish the object, the present invention proposes to float the central value of an image signal depending upon the gradation to be reproduced at each pixel.

In accordance with the present invention, there is provided an active matrix liquid crystal display comprising: a) a plurality of pixel elements respectively associated with pixels on a screen, and having respective switching transistors, respective pixel electrodes respectively coupled with source nodes of the switching transistors, a counter electrode spaced apart from the pixel electrodes and applied with a constant voltage level, and liquid crystal filled between the pixel electrodes and the counter electrode; b) a plurality of driving signal lines selectively coupled with drain nodes of the switching transistors; c ) a means for allowing the switching transistors to selectively turn on to couple the associated driving signal lines to the associated pixel electrodes; and d) a liquid crystal driving circuit driving circuit coupled with the plurality of driving signal lines, and operative to supply an image signal indicative of gradations of the pixels to the driving signal lines, the image signal having voltage range variable with the gradations to be reproduced at each pixel, the liquid crystal driving circuit controlling the image signal in such a manner as to change a central value of the voltage range together with the gradation to be reproduced at each pixel for keeping difference between the central value and the constant voltage level to be constant, thereby canceling variation of a feed-through voltage due to parasitic capacitance between a gate electrode and the source node of each switching transistor.

BRIEF DESCRIPTION OF THE DRAWINGS

The features and advantages of the active matrix liquid crystal display according to the present invention will be more clearly understood from the following description taken in conjunction with the accompanying drawings in which.

DESCRIPTION OF THE PREFERRED EMBODIMENT

Figure 1:
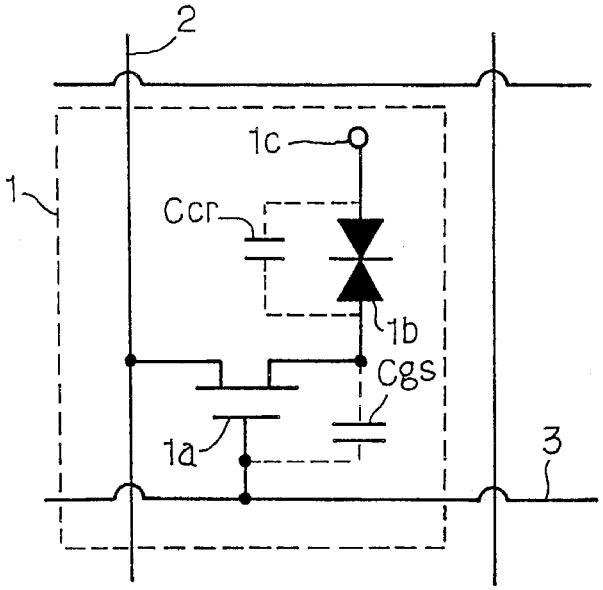
Fig.1 PRIOR ART
FIG. 1 is a circuit diagram showing the arrangement of the pixel element of the prior art active matrix liquid crystal display.
Figure 4:
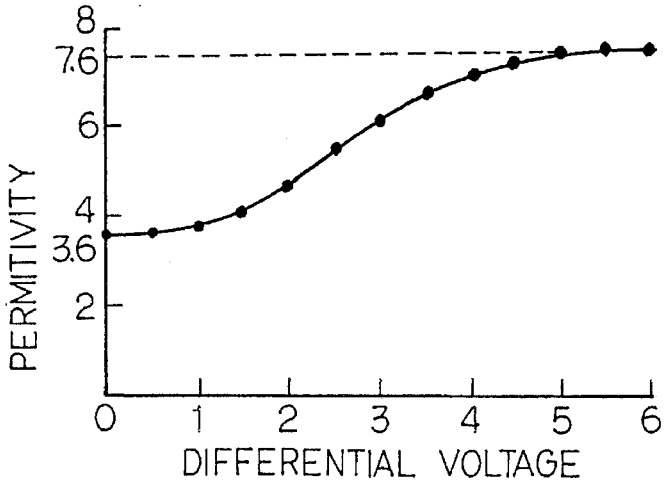
Fig.4 PRIOR ART
FIG. 4 is a graph showing the permittivity of the liquid crystal in terms of the voltage level applied thereto.
Figure 2:
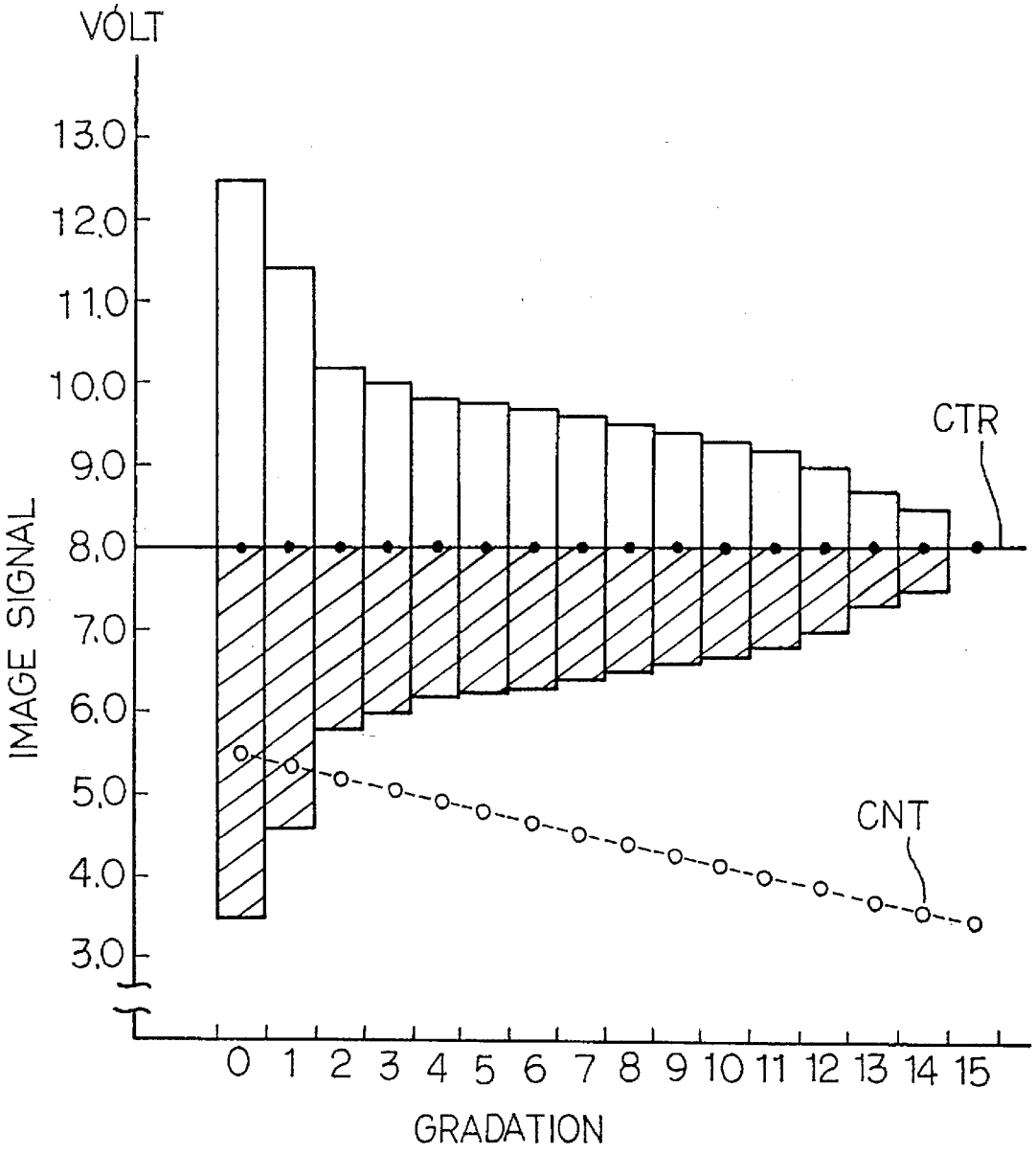
Fig. 2 PRIOR ART
FIG. 2 is a graph showing the image signal in terms of the gradation of the pixel.
Figure 3:
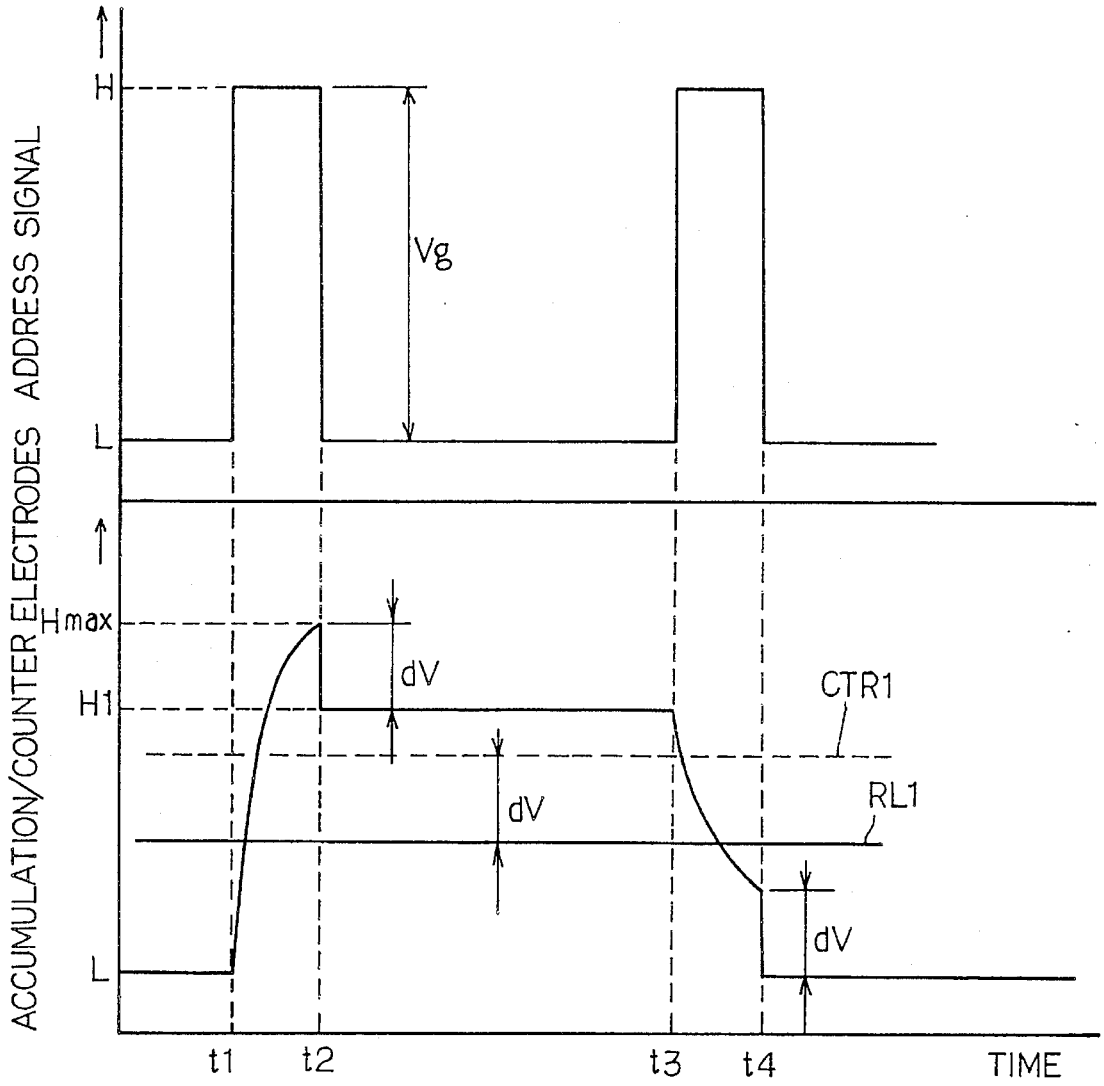
Fig.3 PRIOR ART
FIG. 3 is a diagram showing the waveforms of the address decoded signal and the image signal supplied to the pixel element.
Figure 5:
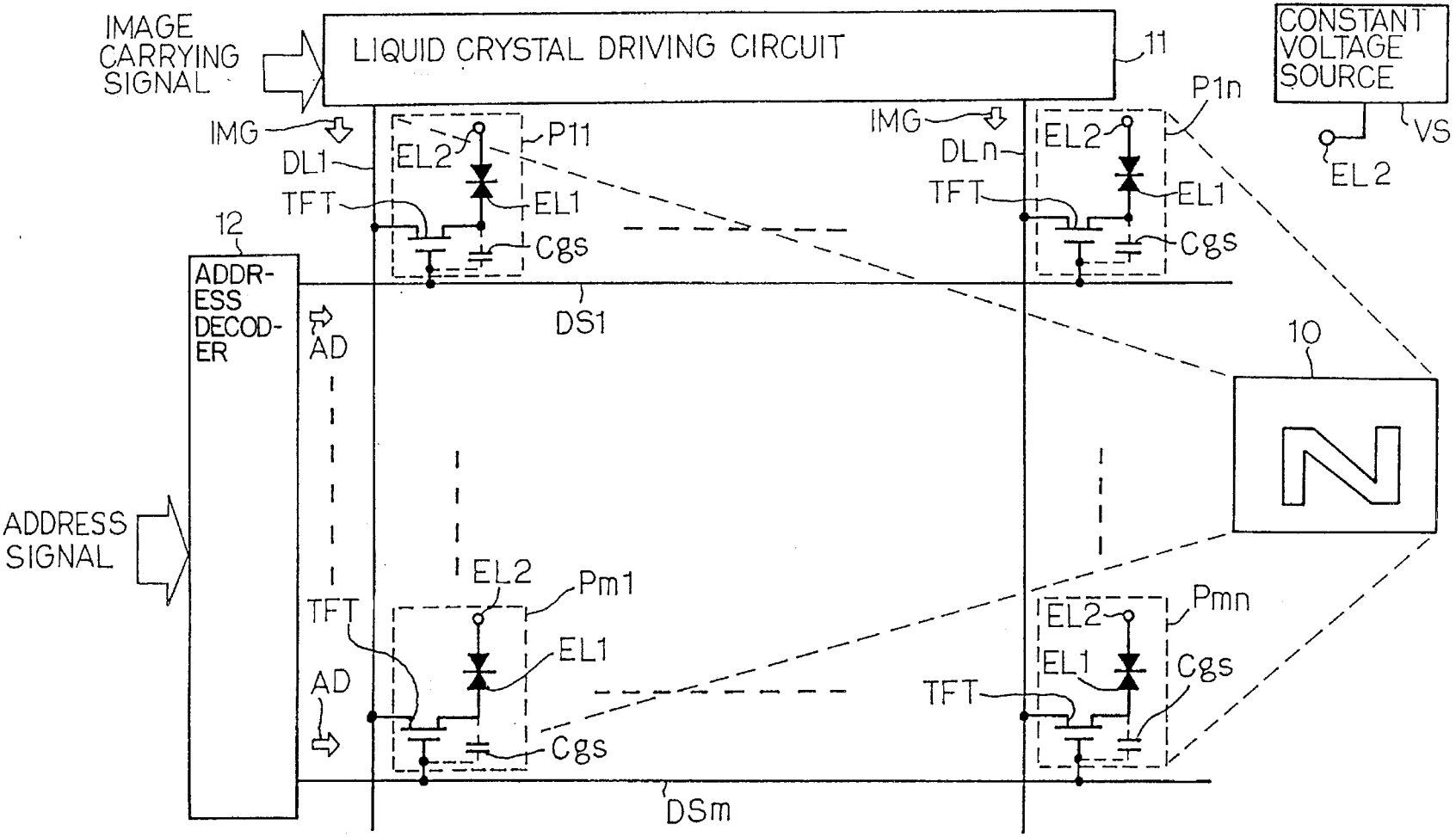
FIG. 5 is a circuit diagram showing the circuit arrangement of an active matrix liquid crystal display according to the present invention.

Referring to FIG. 5 of the drawings, an active matrix liquid crystal display embodying the present invention largely comprises a plurality of pixel elements P11, Pin, Pm1 Pmn, arranged in matrix, and with respectively associated with pixels on a screen 10. The pixels form in combination images such as "N" on the screen 10. The active matrix liquid crystal display further comprises a plurality of driving signal lines DL1 to DLn, respectively associated with the columns of the pixel elements P11 to Pmn, a plurality of address decoded signal lines DS1 to DSm, a liquid crystal driving circuit 11 responsive to a digital image carrying signal for producing an analog image signal IMG indicative of the gradations of the pixels, and an address decoder 12 responsive to an address signal for producing an address decoded signal AD. The analog image signal IMG is supplied to the driving signal lines DL1 to DLn, and the address decoded signal AD is applied to the address decoded signal lines DS1 to DSm.

All of the pixel elements P11 to Pmn are similar to one another, and each comprises a thin film switching transistor TFT and an pixel electrode EL1 coupled with the source node of the thin film switching transistor TFT, and a counter electrode EL2. The pixel elements P11 to Pmn individually have pixel electrodes EL1, and parasitic capacitance Cgs is coupled with each of the pixel electrodes EL1. However, the counter electrode EL2 is shared between the pixel elements P11 to Pmn, and a constant voltage level is supplied from a constant voltage source VS to the counter electrode EL2.

Figure 6:
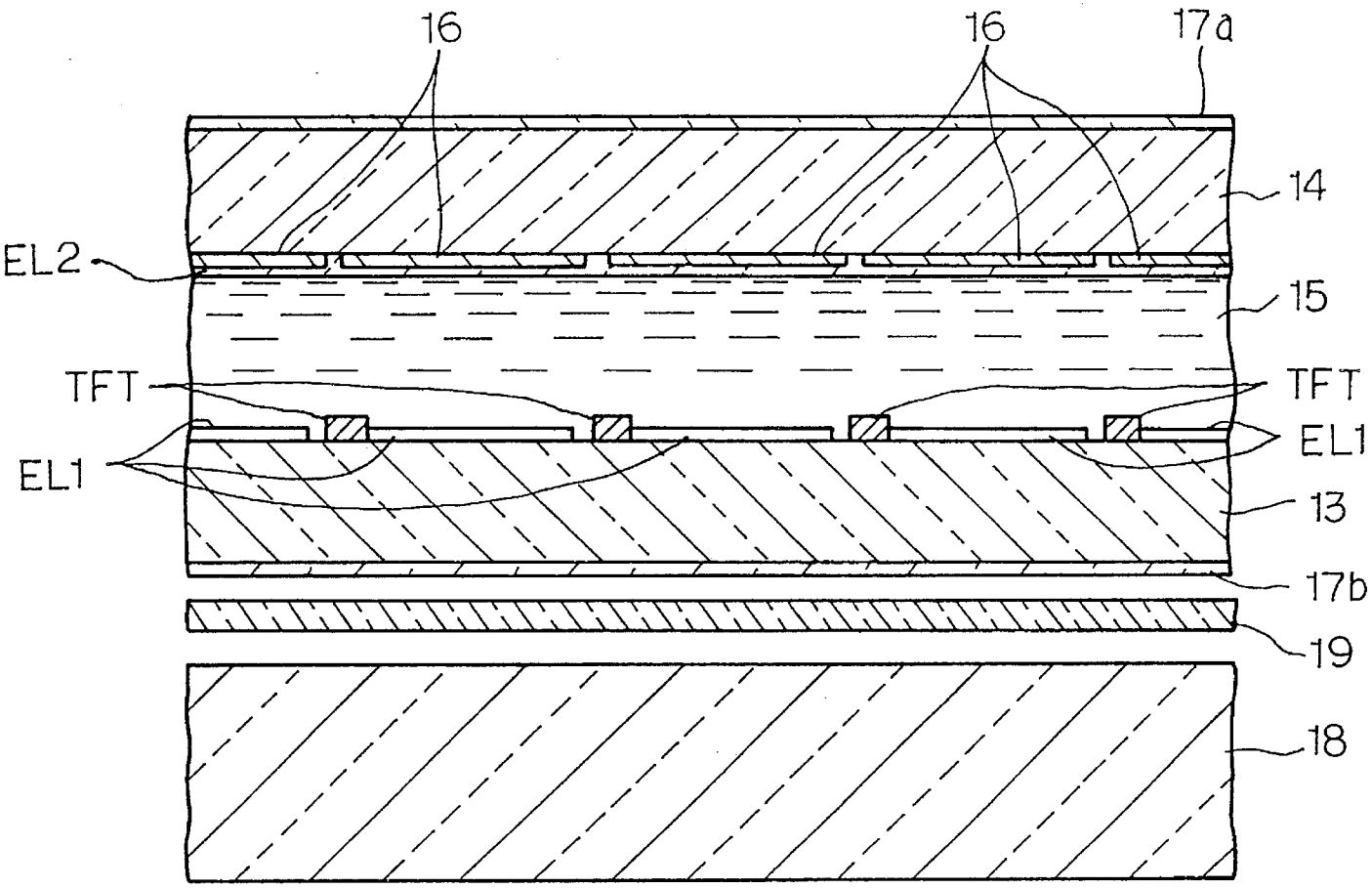
FIG. 6 is a fragmentary cross sectional view showing the structure of the active matrix liquid crystal display.

As will be seen from FIG. 6, the pixel electrode EL1 and the thin film switching transistor TFT are formed on a transparent active matrix substrate 13, and the counter electrode EL2 is provided on a transparent counter substrate 14. The transparent active matrix substrate 13 is spaced apart from the transparent counter substrate 14, and the gap between the substrates 13 and 14 is filled with liquid crystal 15. Color filters 16 are inserted between the counter electrode EL2 and the counter substrate 14, and are selectively colored in red, blue and green. A linear polarizer film 17*a* is provided on the opposite surface of the counter substrate 14, and the opposite surface of the active matrix substrate 13 is also overlain by a linear polarizer film 17*b*. An illuminating device 18 radiates light through a light diffuser plate 19 to the linear polarizer film 17*b*, and the light is incident on the liquid crystal 15. The transmissivity of the liquid crystal 15 is variable with differential voltage applied between the pixel electrodes EL1 and the counter electrode EL2, and the liquid crystal 15, the array of the pixel electrodes EL1 and the counter electrode EL2 imparts the gradations to the pixels on the screen 10 for reproducing an image.

Turning back to FIG. 5 of the drawings, the driving signal lines DL1 to DLn propagate the analog image signal IMG indicative of the gradations of the pixels, and the address decoded signal AD allows the thin film switching transistors TFT to selectively turn on for transferring the analog image signal IMG to the associated pixel electrodes EL1. The address decoder 12 is well known to a person skilled in the art, and no description is incorporated hereinbelow for the sake of simplicity. However, the liquid crystal driving circuit 11 directly relates to the gist of the present invention, and is described in detail with reference to FIGS. 7 and 8.

Figure 7:
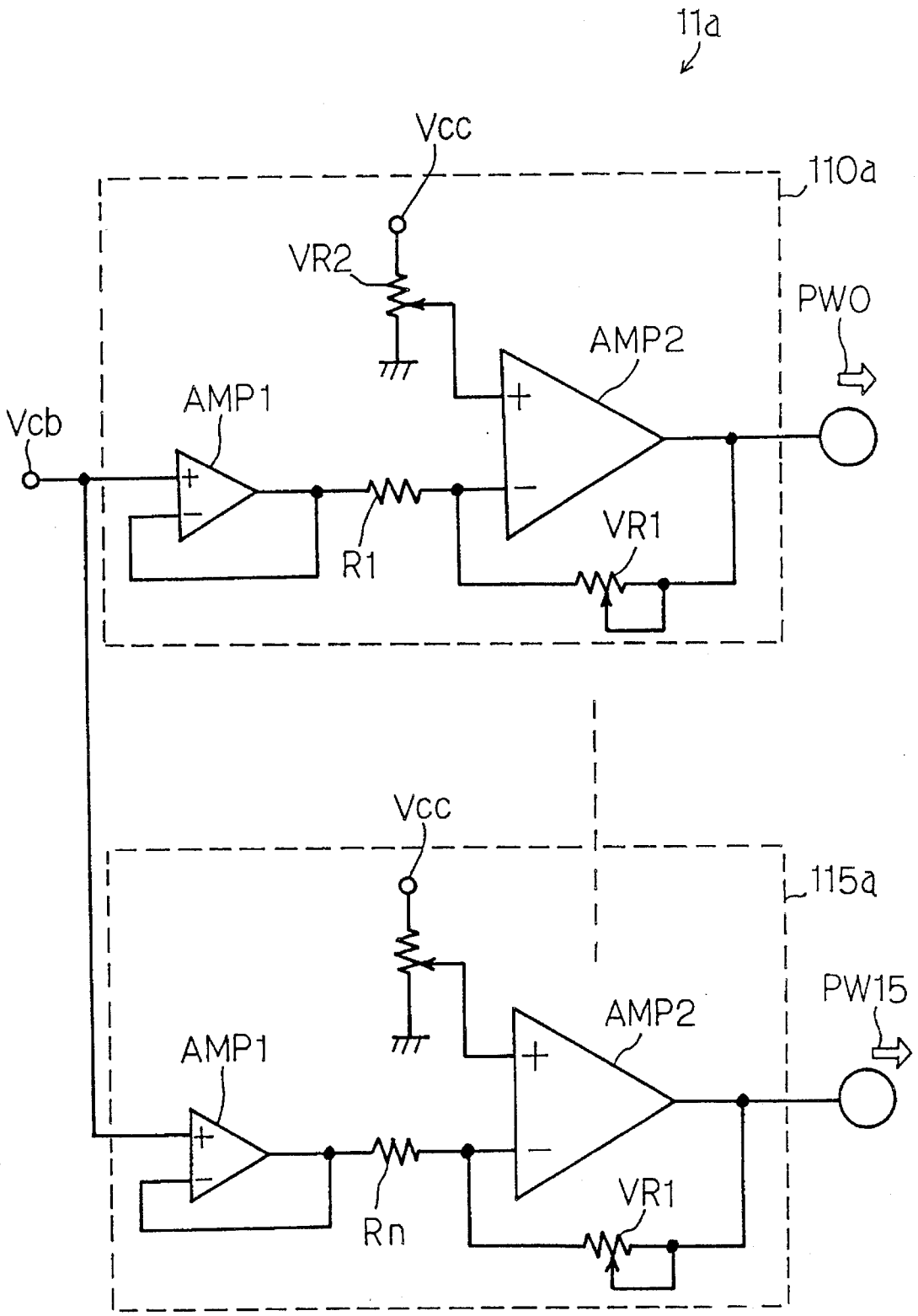
FIG. 7 is a circuit diagram showing the circuit arrangement of a power supply circuit incorporated in the active matrix liquid crystal display.
Figure 8:
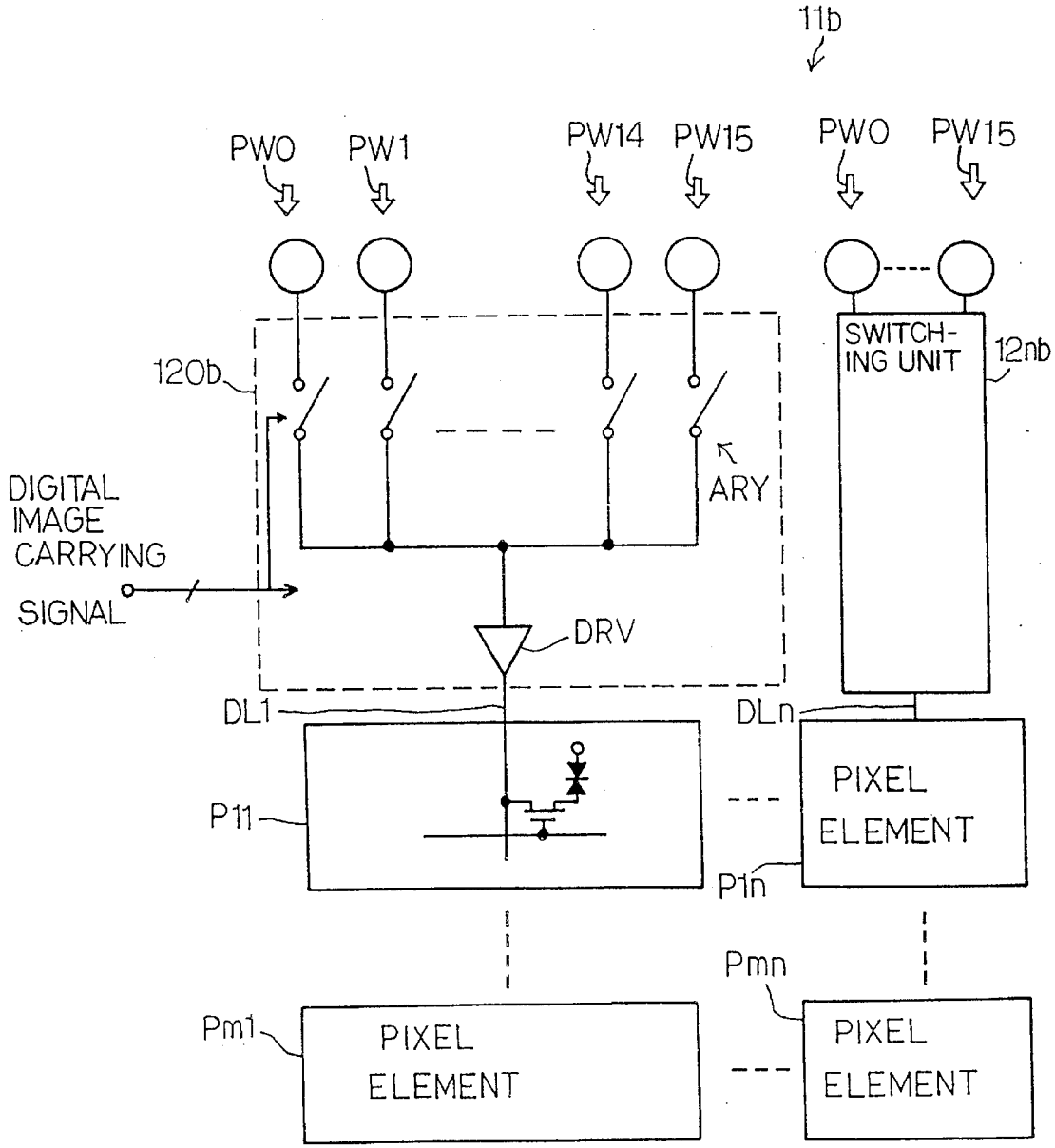
FIG. 8 is a circuit diagram showing the circuit arrangement of a switching circuit associated with the power supply circuit.

The liquid crystal driving circuit 11 comprises a power supply circuit 11*a* shown in FIG. 7, and a switching circuit 11*b* shown in FIG. 8. In this instance, each of the pixel components P11 to Pmn imparts one of sixteen gradations to the associated pixel, and, accordingly, the power supply circuit 11*a* is implemented by sixteen voltage sources 11*a*0 to 11*a*15 respectively producing output voltage signals PW0 to PW15 different from one another. All of the voltage sources 110*a* to 115*a* are similar in circuit arrangement to one another, and each of the voltage sources 110*a* to 115*a* comprises a pre-amplifier AMP1, a non-variable resistor R1, . . . or Rn, an operational amplifier AMP2, a variable feedback resistor VR1 coupled between the output node and the inverted node of the operational amplifier AMP2, and a variable offset resistor VR2 coupled with the non-inverted node of the operational amplifier AMP2. The variable feedback resistor VR1 is operative to change the amplitude or the voltage range of the associated output voltage signal, and the variable offset resistor VR2 is used for changing the central value of the amplitude of the associated output voltage signal. The feedback resistor VR1 and the offset resistor VR2 are regulated in such a manner as to step-wise change the amplitudes and central values of the output voltage signals PW0 to PW15.

Turning to FIG. 8 of the drawings, the switching circuit 11*b* is implemented by n switching units 12*bo* to 12*nb*, and the switching units 12*bo* to 12*bn* are respectively associated with the driving signal lines DL1 to DLn. All of the switching units 12*bo* to 12*bn* are similar in circuit arrangement to one another, and each of the switching units 12*bo* to 12*bn* comprises a switch array ARY coupled with the sixteen voltage sources 11*a*0 to 11*a*15, respectively, and an output driver DRV coupled between the switch array ARY and the associated driving signal line DL1, . . . or DLn. The digital image carrying signal is supplied to the switch arrays ARY of the switching units 12*bo* to 12*bn*, and allows the switch arrays to selectively transfer the output voltage signals PW0 to PW15 to the associated driving signal lines DL1 to DLn for supplying the analog image signal IMG to the driving signal lines DL1 to DLn.

Figure 9:
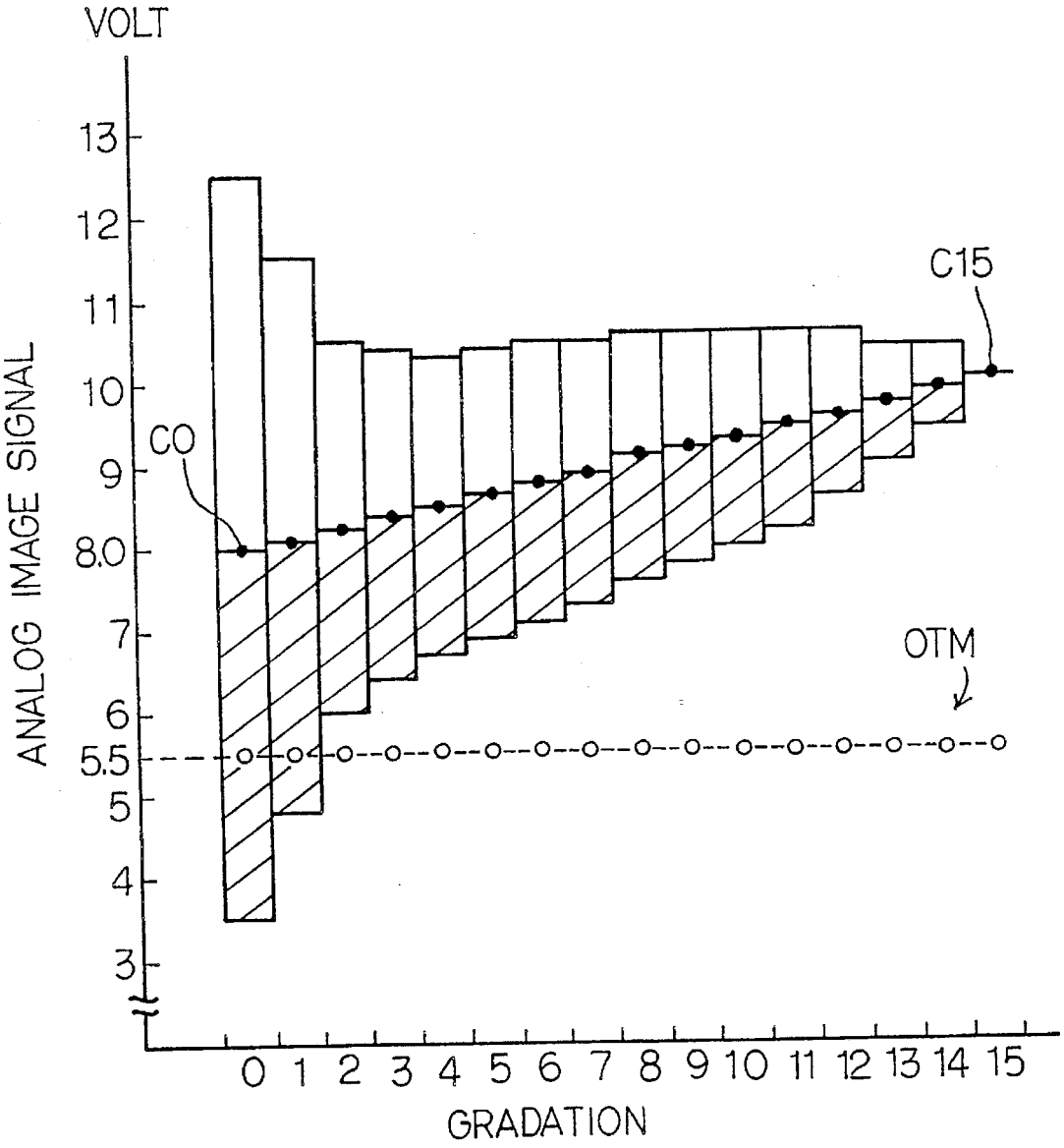
FIG. 9 is a graph showing an image signal in terms of gradation.

The output voltage signals PW0 to PW15 correspond to the sixteen gradations, and one of the sixteen gradations is imparted to each of the pixels as described hereinbefore. In this instance, the analog image signal IMG varies the amplitude or the voltage range thereof as shown in FIG. 9, and the central value is changed from C0 to C15 depending upon the gradation to be reproduced at each pixel on the screen 10.

The central value C0 to C15 of the analog image signal IMG indicative of each gradation is determined as follows. First, a spectrum analyzer is prepared and is confronted to the screen of the prior art active matrix liquid crystal display. The analog image signal indicative of one of the sixteen gradations is supplied to the pixel components, and a voltage level is applied to the counter electrode. The spectrum analyzer measures the flicker component. The voltage level at the counter electrode is varied, and the spectrum analyzer continuously measures the flicker component. If the flicker component is minimized at a certain voltage level, the certain voltage level is the optimum voltage level at the gradation. The gradation is sequentially changed from "0" to "15" and the optimum values OTMx are determined from the minimum flicker component. If the optimum value at the counter electrode EL2 is 5.5 volts for the analog image signal IMG indicative of the gradation "0" as shown in FIG. 9, the correction values dIMGx at gradation "x" (where X ranges from 1 to 15) is given by Equation 4.

$$dIMGx=-1\times(OTMx-5.5) \qquad \text{Equation 4}$$

If the central value C0 of the analog image signal IMG is 8.0 volts, the central value Cx of the analog image signal IMG indicative of the gradation "x" is given by Equation 5.

$$Cx=8.0\text{ volts}+dIMGx \qquad \text{Equation 5}$$

The voltage sources 11*a*0 to 11*a*15 are regulated to allow the analog image signals IMG to have the central values C0 to C15, and the floating analog image signal IMG causes the pixel components P11 to Pmn to reproduce an image on the screen 10.

If the analog image signals IMG are regulated as described hereinbefore, the optimum values OTM according to the present invention are constant at 5.5 volts as shown in FIG. 9, and the counter electrode EL2 is adjusted to 5.5 volts without any problems inherent in the prior art active matrix liquid crystal display. As described in connection with the prior art active matrix liquid crystal display, the feed-through voltage dV is variable together with the gradation to be reproduced at each pixel, and the correction value dIMGx cancels the variation of the feed-through voltage dV, and, for this reason, difference between the central value Cx and the constant voltage level at the counter electrode EL2 is kept constant.

As will be understood from the foregoing description, the active matrix liquid crystal display according to the present invention reproduces an image with the floating analog image signal, and is free from the problems inherent in the prior art active matrix liquid crystal display.

Although particular embodiments of the present invention have been shown and described, it will be obvious to those skilled in the art that various changes and modifications may be made without departing from the spirit and scope of the present invention. For example, the color filters 16 may be deleted from another active matrix liquid crystal display according to the present invention. Moreover, the analog image signal used in the above described embodiment is indicative of one of the sixteen gradations reproduced on the screen. However, another active matrix liquid crystal display according to the present invention may reproduce more than or less than sixteen gradations on the screen. In other words, the number of gradations to be reproduced does not relate to the gist of the present invention. Finally, the component circuits of the active matrix liquid crystal display according to the present invention may be integral into a single unit or separated into a plurality of component units.

What is claimed is:

1. An active matrix liquid crystal display comprising:

a plurality of pixel elements arranged in a matrix form, said pixel elements including respective switching transistors, each said switching transistor having a gate electrode, a first electrode connected to a pixel electrode, and a second electrode;

a plurality of first signal lines each coupled to the second electrode of associated ones of said switching transistors;

a plurality of second signal lines each coupled to the gate electrode of associated ones of said switching transistors; and a driving circuit coupled to said first signal lines and supplying each respective one of said first signal lines with a selected one of a plurality of image signal voltages in accordance with a gradation to be reproduced at a respective pixel element, said image signal voltages having respective voltage amplitudes different from one another to indicate correspondingly different gradations thereamong, and said image signal voltages further having respective center values of the respective voltage amplitudes, wherein said respective center values are voltage values about which the respective voltage amplitudes oscillate and wherein said respective center values are different from one another.

2. The liquid crystal display as claimed in claim 1, wherein said image signal voltages include at least first image signal voltage having a first voltage amplitude and a first center value thereof, and second image signal voltage having a second voltage amplitude and a second center value thereof, the second voltage amplitude being smaller than said first voltage amplitude, and the second center value being higher than said first center value.

3. The liquid crystal display as claimed in claim 2, further comprising a counter electrode facing said pixel electrode with liquid crystal therebetween, and supplied with a bias voltage.

4. A active matrix liquid crystal display comprising:

a plurality of pixel elements arranged in a matrix form, said pixel elements comprising respective switching transistors, each said switching transistor having a gate electrode, a first electrode, and a second electrode, and respective pixel electrodes each connected to said first electrode of an associated one of said switching transistors, each of said switching transistors being responsive to an active voltage level applied to said gate electrode and rendered conductive to transfer a voltage signal applied to said second electrode to said first electrode;

a plurality of first signal lines each coupled to the gate electrode of associated ones of said switching transistors;

a first driver circuit coupled to said first signal lines and sequentially bringing said first signal lines to said active voltage level;

a plurality of second signal lines each coupled to the second electrode of associated ones of said switching transistors;

a plurality of voltage generators generating respective signal voltages having respective voltage amplitudes different from one another to represent a difference in gradation thereamong, said signal voltages further having respective center values of the respective voltage amplitudes, wherein said respective center values are voltage values about which the respective voltage amplitudes oscillate and wherein said respective center values are different from one another; and a plurality of switching units provided correspondingly to said second signal lines, each of said switching units being coupled to said voltage generators to receive said respective signal voltages, and selecting and supplying one of said respective signal voltages to an associated one of said second signal lines, said one of said respective signal voltages being indicative of a gradation to be reproduced at a pixel element.

5. The liquid crystal display as claimed in claim 4, wherein said signal voltages include at least a first signal voltage having a first voltage amplitude and a first center value thereof, and a second signal voltage having a second voltage amplitude and a second center value thereof, the second voltage amplitude being smaller than said first voltage amplitude, and the second center value being higher than said first center value.

6. An active matrix liquid crystal display apparatus comprising:

a liquid crystal display including a plurality of pixel elements, said pixel elements including respective switching transistors, each said switching transistor having a gate electrode, a first electrode, and a second electrode, a plurality of pixel electrodes each connected to said first electrode of an associated one of said switching transistors, a counter electrode provided spaced apart from said pixel electrodes, and liquid crystal inserted between said pixel electrodes and said counter electrode;

a plurality of first signal lines each coupled to the gate electrode of associated ones of said switching transistors;

a plurality of second signal lines each connected to the second electrode of associated ones of said switching transistors;

a first drive circuit coupled to said first signal lines and driving in sequence said first signal lines; and a second drive circuit coupled to said second signal lines and driving each of said second signal lines with a selected one of a plurality of image signal voltages indicative of a gradation to be displayed at a respective one of said pixel elements, said image signal voltages having respective voltage amplitudes different from one another to indicate a difference in gradation thereamong, and said image signal voltages further having respective center values of the respective voltage amplitudes, wherein said respective center values are voltage values about which the respective voltage amplitudes oscillate and wherein said respective center values are different from one another.

7. The apparatus as claimed in claim 6, wherein said image signal voltages include at least a first image signal voltage having a first voltage amplitude and a first center value thereof, and a second image signal voltage having a second voltage amplitude and a second center value thereof, the second voltage amplitude being smaller than said first voltage amplitude, and the second center value being higher than said first center value.

8. The apparatus as claimed in claim 7, wherein said second drive circuit includes a plurality of voltage generators each generating a different one of said image signal voltages, and a plurality of switching units provided correspondingly to said second signal lines, each of said switching units being coupled to said voltage generators to receive said image signal voltages, and selecting and supplying one of said image signal voltages to an associated one of said second signal lines.

9. An active matrix liquid crystal display comprising:

a plurality of pixel elements arranged in a matrix form, said pixel elements including respective switching transistors, each said switching transistor having a gate electrode, a first electrode connected to a pixel electrode, and a second electrode;

a plurality of first signal lines each coupled to the second electrode of associated ones of said switching transistors;

a plurality of second signal lines each coupled to the gate electrode of associated ones of said switching transistors; and a driving circuit coupled to said first signal lines and supplying each respective one of said first signal lines with a selected one of a plurality of image signal voltages in accordance with a gradation to be reproduced at a respective pixel element, said image signal voltages having respective voltage amplitudes different from one another to indicate correspondingly different gradations thereamong, said image signal voltages further having respective center reference values for the respective voltage amplitudes, said respective center reference values being different from one another, and said image signal voltages including at least:

a first image signal voltage having a first voltage amplitude and a first center reference value therefor, and a second image signal voltage having a second voltage amplitude and a second center reference value therefor, the second voltage amplitude being smaller than said first voltage amplitude, and the second center value being higher than said first center reference value.

10. The liquid crystal display as claimed in claim 9, further comprising a counter electrode facing said pixel electrode with liquid crystal therebetween, and supplied with a bias voltage.

11. A active matrix liquid crystal display comprising:

a plurality of pixel elements arranged in a matrix form, said pixel elements comprising respective switching transistors, each said switching transistor having a gate electrode, a first electrode, and a second electrode, and respective pixel electrodes each connected to said first electrode of an associated one of said switching transistors, each of said switching transistors being responsive to an active voltage level applied to said gate electrode and rendered conductive to transfer a voltage signal applied to said second electrode to said first electrode;

a plurality of first signal lines each coupled to the gate electrode of associated ones of said switching transistors;

a first driver circuit coupled to said first signal lines and sequentially bringing said first signal lines to said active voltage level;

a plurality of second signal lines each coupled to the second electrode of associated ones of said switching transistors;

a plurality of voltage generators generating respective signal voltages having respective voltage amplitudes different from one another to represent a difference in gradation thereamong, said signal voltages further having respective center reference values for the respective voltage amplitudes, said respective center reference values being different from one another; and a plurality of switching units provided correspondingly to said second signal lines, each of said switching units being coupled to said voltage generators to receive said respective signal voltages, and selecting and supplying one of said respective signal voltages to an associated one of said second signal lines, said one of said respective signal voltages being indicative of a gradation to be reproduced at a pixel element, and said signal voltages including at least:

a first signal voltage having a first voltage amplitude and a first center reference value therefor, and a second signal voltage having a second voltage amplitude and a second center reference value therefor, the second voltage amplitude being smaller than said first voltage amplitude, and the second center reference value being higher than said first center reference value.

12. An active matrix liquid crystal display apparatus comprising:

a liquid crystal display including a plurality of pixel elements, said pixel elements including respective switching transistors, each said switching transistor having a gate electrode, a first electrode, and a second electrode, a plurality of pixel electrodes each connected to said first electrode of an associated one of said switching transistors, counter electrode provided spaced apart from said pixel electrodes, and a liquid crystal inserted between said pixel electrodes and said counter electrode;

a plurality of first signal lines each coupled to the gate electrode of associated ones of said switching transistors;

a plurality of second signal lines each connected to the second electrode of associated ones of said switching transistors;

a first drive circuit coupled to said first signal lines and driving in sequence said first signal lines; and a second drive circuit coupled to said second signal lines and driving each of said second signal lines with a selected one of a plurality of image signal voltages indicative of a gradation to be displayed at a respective one of said pixel elements, said image signal voltages having respective voltage amplitudes different from one another to indicate a difference in gradation thereamong, said image signal voltages further having respective center reference values for the respective voltage amplitudes, said respective center reference values being different from one another, and said image signal voltages including at least:

a first image signal voltage having a first voltage amplitude and a first center reference value therefor, and a second image signal voltage having a second voltage amplitude and a second center reference value therefor, the second voltage amplitude being smaller than said first voltage amplitude, and the second center reference value being higher than said first center reference value.

13. The apparatus as claimed in claim 12, wherein said second drive circuit includes a plurality of voltage generators each generating a different one of said image signal voltages, and a plurality of switching units provided correspondingly to said second signal lines, each of said switching units being coupled to said voltage generators to receive said image signal voltages, and selecting and supplying one of said image signal voltages to an associated one of said second signal lines.

* * * * *